United States Patent [19]

Maeda

[11] Patent Number: 4,509,320

[45] Date of Patent: Apr. 9, 1985

[54] ELASTIC COVERED YARN AND METHOD AND APPARATUS FOR PRODUCING THE SAME

[76] Inventor: Senichi Maeda, 462 Shinhakusuimaru-cho, Ichijyo-Sagaru, Chiekoindori, Kamigyo-ku, Kyoto, Japan

[21] Appl. No.: 476,608

[22] Filed: Mar. 18, 1983

[30] Foreign Application Priority Data

Apr. 5, 1982 [JP] Japan ..... 57-57086
Jul. 16, 1982 [JP] Japan ..... 57-124615

[51] Int. Cl.[3] ..... D02G 3/32

[52] U.S. Cl. ..... 57/225; 57/12; 57/18

[58] Field of Search ..... 57/3, 6, 12, 14, 17, 57/18, 210, 225, 228, 236, 237, 238, 243, 244, 224

[56] References Cited

U.S. PATENT DOCUMENTS

| | | | |
|---|---|---|---|
| 2,044,130 | 6/1936 | Sowter | 57/224 X |
| 3,011,302 | 12/1961 | Rupprecht | 57/12 X |
| 3,124,924 | 3/1964 | Smith | 57/18 |
| 3,309,863 | 3/1967 | Hermes | 57/12 |
| 3,504,410 | 4/1970 | Alexandre | 57/225 X |
| 3,983,687 | 10/1976 | Lewis | 57/225 X |

*Primary Examiner*—Donald Watkins
*Attorney, Agent, or Firm*—Kirschstein, Kirschstein, Ottinger & Israel

[57] ABSTRACT

An elastic covered yarn and a method and apparatus for producing the same, wherein an elastic yarn is wrapped in stretched condition around a nonelastic yarn as a core yarn, the contracting action of the stretched elastic yarn causing the elastic yarn to take the position of the core yarn, covered with the nonelastic yarn.

4 Claims, 7 Drawing Figures

ELASTIC COVERED YARN AND METHOD AND APPARATUS FOR PRODUCING THE SAME

BACKGROUND OF THE INVENTION

The present invention relates to an elastic covered yarn and a method and apparatus for producing the same, wherein an elastic yarn having stretch elasticity, such as spandex, is used as a core yarn and is covered with a nonelastic yarn, such as wooly nylon yarn, acrylic yarn, wool yarn or silk yarn.

Conventionally, in producing elastic covered yarns such as the one described above, it has been usual practice to wrap a nonelastic yarn around an elastic yarn as a core yarn. As for the production method, it has been taken for granted that while an elastic yarn is continuously traveling in stretched condition in one direction axially through a rotary bobbin having a nonelastic yarn wound thereon, the nonelastic yarn being unwound from the bobbin is wrapped around the elastic yarn. In such case, however, the nonelastic yarn is inevitably twisted in one direction as it is wrapped around the elastic yarn. This twist reduces or increases the desirable twist initially imparted to the nonelastic yarn, thus detracting from the hand of the nonelastic yarn, so that a satisfactory product cannot be obtained. Further, in such case, because it is the nonelastic yarn, which is consumed far more than the elastic yarn, that has to be used in the form of a compact winding on a rotary bobbin, it is inevitable to avoid the operation of frequently rewinding the nonelastic yarn initially packaged in cheese or other compact form onto the bobbin, said rewinding operation accounting for the greater part of the production process, so that the production efficiency has been low.

SUMMARY OF THE INVENTION

The present invention eliminates the drawbacks described above, and provides an elastic covered yarn of satisfactory hand, an efficient method of producing the same, and an advantageous apparatus directly used for carrying out said method.

The feature of the elastic covered yarn of the present invention is that it is formed by wrapping an elastic yarn in stretched condition around a nonelastic yarn as a core yarn, the contracting action of said stretched elastic yarn causing the elastic yarn to take the position of the core yarn, covered with the nonelastic yarn. More particularly, according to the invention, in contrast to the conventional way of formation in which the nonelastic yarn is wrapped around the elastic yarn, the elastic yarn is wrapped around the nonelastic yarn, and in this case, the wrapping yarn, i.e., the elastic yarn which has been stretched is contracted, whereby the elastic and nonelastic yarns change positions so that the elastic yarn has the nonelastic yarn wrapped therearound and is covered with it. Thus, in this type of elastic covered yarn, the nonelastic yarn is not twisted, nor is the hand is spoiled; the elastic yarn is stretched and contracted in such a manner that it is softly wrapped around the nonelastic yarn, with the initial satisfactory hand of the nonelastic yarn retained. Thus, this elastic covered yarn is characterized in that it has very good hand. Thus, this elastic covered yarn can be used in knitting to impart elasticity to knit apparel, providing a product having very good hand.

A method of producing such an elastic covered yarn according to the present invention comprises the step of continuously running a nonelastic yarn under a predetermined tension in one direction, while continuously wrapping an elastic yarn in stretched condition around said nonelastic yarn during running. According to such method, in using the nonelastic yarn, which is consumed far more than the elastic yarn as experiences indicate that the consumption of elastic yarn is 5–10% of that of nonelastic yarn, it is no longer necessary to withdraw the nonelastic yarn from a bobbin onto which it has been compactly rewound, and instead it can be used by withdrawing it from a cheese or other form in which a large amount of nonelastic yarn is wound, while the elastic yarn, which is less consumed, can be wound on a bobbin, from which it is withdrawn in use. Thus, the frequency of rewinding yarn onto bobbins can be greatly reduced, a fact which is very advantageous from the standpoint of efficiency of operation. Thus, desired elastic covered yarns can be produced at very low costs.

An apparatus used in carrying out such a method comprises a stretch feeder for continuously pulling and running a nonelastic yarn from its supply section to a take-up section, a wrapping device for wrapping an elastic yarn around said nonelastic yarn between said supply section and said stretch feeder, said wrapping device comprising a rotary bobbin having said elastic yarn wound thereon, a rotary disk rotating with said bobbin, and a rotatable press disk disposed concentrically with and pressed against said rotary disk, said nonelastic yarn being passed axially through said rotary bobbin, rotary disk and press disk, the arrangement being such that said elastic yarn being unwound from said rotary bobbin is passed between the pressure surfaces of said rotary and press disks and wrapped around said nonelastic yarn. According to such apparatus, when the elastic yarn being unwound from the rotary bobbin is passed between the pressure surfaces of the rotary and press disks, it is subjected to a braking force depending upon the pressure between the pressure surfaces of said rotary and press disks, whereby the elastic yarn is wrapped in stretched condition around the nonelastic yarn, enabling production of a desired elastic covered yarn.

In a method according to a preferred embodiment of the invention, the elastic yarn is wound in the form of an elastic yarn bobbin such that the amount of winding per course around the bobbin is substantially constant irrespective of changes in the winding diameter of the bobbin, and the elastic yarn is wrapped around the nonelastic yarn while the elastic yarn is positively unwound from said elastic yarn bobbin at a constant speed. The advantage of this method is that the amount of unwinding per course around the elastic yarn bobbin, i.e., the actual unwound length calculated for nonstretched condition is substantially constant, so that this unwinding is positively effected at a constant speed, enabling the wrapping of the elastic yarn around the nonelastic yarn to be realized in such a condition that the degree of stretch of the elastic yarn is stabilized without any variation at all times and maintained accurately at a constant value, whereby there is obtained an excellent elastic covered yarn in which the nonelastic yarn is wrapped around the elastic yarn evenly at an accurate pitch. An apparatus for carrying out this method is characterized in that the wrapping device mentioned in the previously described apparatus comprises an elastic yarn bobbin having the elastic yarn wound thereon such that the amount of winding per course around the bobbin is substantially constant irrespective of changes in the winding diameter of the bobbin, a flyer supported substantially concentrically with said bobbin and capable of executing relative rotative motion at a constant speed relative to said bobbin, said relative rotative motion serving to guide the unwinding of said elastic yarn from said bobbin at a constant speed, and a guide passage for guiding and running the nonelastic yarn in a direction extending substantially along the axes of said bobbin and said flyer, the arrangement being such that the elastic yarn being unwound from said bobbin while being guided by said flyer is wrapped around the running nonelastic yarn leaving said guide passage by the rotative motion of the flyer.

BRIEF DESCRIPTION OF THE DRAWINGS

FIG. 3 is a side view of a portion of the elastic covered yarn of the invention.

PREFERRED EMBODIMENTS OF THE INVENTION

Embodiments of the invention will now be described with reference to the drawings.

Figure 1:
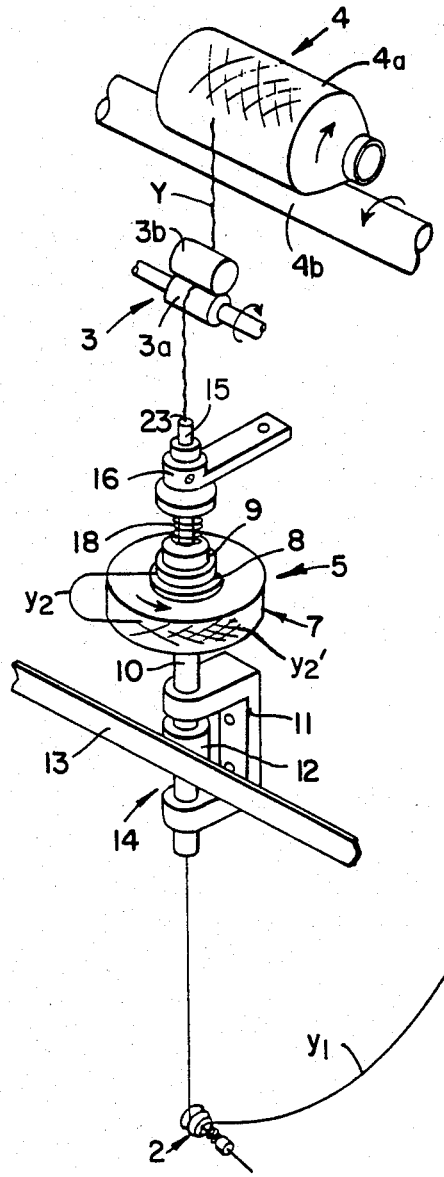
FIG. 1 is a perspective view of an example of an apparatus embodying the method of the present invention.

FIG. 1 shows an example of an apparatus for embodying the method of the invention. This apparatus includes a nonelastic yarn supply section 1 and a tension guide 2, which are disposed at lower positions 1 in the lower region. The supply section 1 is shown as a nonelastic yarn wound body 1*a* of wooly nylon yarn, acrylic yarn, wool yarn or other desired nonelastic yarn wound in cheese or other suitable form, from which the nonelastic yarn $y_1$ is unwound in a negative manner. Disposed at a predetermined position above the tension guide 2 is a yarn stretch feeder 3 comprising nip rollers 3*a* and 3*b* rotated at a constant speed, and disposed at a predetermined position above said stretch feeder 3 is a take-up section 4 for winding yarn at a constant speed, comprising a take-up bobbin 4*a* and a drum 4*b* carrying said bobbin and rotating at a constant speed. Thus, the stretch feeder 3 pulls and continuously runs the nonelastic yarn $y_1$ from the supply section 1 via the tension guide 2, said yarn being taken up by the take-up section 4; during running, the nonelastic yarn $y_1$ is maintained under a constant tension in a region from the tension guide 2 to the stretch feeder 3. The winding speed of the take-up section 4 is slightly lower than the stretching speed of the stretch feeder 3.

Disposed at a predetermined position in the region for the nonelastic yarn $y_1$ from the supply section 1 via the tension guide 2 to the stretch feeder 3 is a wrapping device 5 for wrapping an elastic yarn $y_2$ such as spandex, around the nonelastic yarn $y_1$. The wrapping device 5 comprises a rotary bobbin 7 having the elastic yarn $y_2$ wound thereon in the form of a winding $y_2$, a rotary disk 8 rotating with said bobbin 7, and a rotatable press disk 9 adapted to be pressed against the rotary disk 8, said two disks being coaxially arranged, the arrangement being such that the nonelastic yarn $y_1$ is passed axially through said bobbin 7, rotary disk 8 and press disk 9, while the elastic yarn $y_1$ being unwound from the bobbin 7 is passed between the pressure surfaces of the rotary disk 8 and press disk 9 and wrapped around the nonelastic yarn $y_1$.

The wrapping device 5 will now be described in more detail with reference to FIG. 3.

The rotary bobbin 7 is mounted on the top of a cylindrical upright spindle 10 having a guide passage 21 in the center through which the nonelastic yarn $y_1$ travels. The rotary disk 8 is integrally mounted on the upper surface of the bobbin 7. The hollow spindle 10 is rotatably supported by a bearing 11 supported on the frame (not shown) of the apparatus. The hollow spindle 10 is rotated at a constant speed by rotary drive means 14 comprising a driven body 12, such as a roller or pulley, and a rotary drive belt 13, whereby the rotary bobbin 7 and rotary disk 8 are rotated at a constant speed. In addition, the rotary disk 8 may be installed separate from the bobbin, provided that the rotary disk 8 is rotated with the bobbin 7.

The press disk 9 is disposed above the rotary disk 8 so that its lower surface is opposed to the surface of the rotary disk 8. The press disk 9 has a throughgoing hole 22 and is rotatably engaged with the lower portion of a cylindrical upright hollow shaft 15 having in the center a guide passage 23 communicating with said throughgoing hole 22, through which the nonelastic yarn $y_1$ travels. The hollow shaft 15 is disposed above and concentrically with said hollow spindle 10 and vertically movably supported by a bearing 16 supported on the frame (not shown) of the apparatus. The lower end 15*a* of the hollow shaft 15 is semispherical and downwardly contacts a bearing 17 placed on the press disk 9. A spring 18 for downwardly urging the hollow shaft 15 along the bearing 16 is installed between the lower portion of the hollow shaft 15 and the bearing 16. Thus, the semispherical lower end 15*a* of the hollow shaft 15 presses the bearing 17, so that the lower surface of the press disk 9 is urged against the upper surface of the rotary disk 8. Thus, the friction causes the press disk 9 to follow the rotation of the rotary disk 8 and to thereby rotate smoothly by means of the bearing 17 relative to the hollow shaft 15. Further, the press disk 9 is uniformly pressed against the rotary disk at all times.

The spring 18 is not always necessary, and in some cases, it may be removed so that the press disk 9 is pressed against the rotary disk 8 under its own weight. The rotary and press disks 8 and 9 may be made of iron or other metal or rigid plastics or any other suitable material, but it is preferable to apply a fabric, such as woolen cloth or flannel to the surface of at least one of the disks and to provide an elastic layer 20 of elastic synthetic resin or the like underlying said fabric. Thus, in this wrapping device 5, the nonelastic yarn $y_1$ is passed through the guide passage 21 of the hollow spindle 10, the throughgoing hole 22 of the press disk 9 and the guide passage 23 of the hollow shaft 15 to travel vertically through the centers of the bobbin 7 and rotary and press disks 8 and 9, while the elastic yarn $y_2$ being unwound from the bobbin 7 is passed between the pressure surfaces of the rotary and press disks 8 and 9 and wrapped around the nonelastic yarn $y_1$.

In the arrangement described above, the nonelastic yarn $y_1$ is pulled by the stretch feeder 3 and travels at a fixed speed under a fixed tension, and when the bobbin 7 and rotary disk 8 are rotated, the press disk 9 is thereby rotated, and the elastic yarn $y_2$ is uniformly unwound to pass between the pressure surfaces of the rotary and press disks 8 and 9 and is wrapped around the nonelastic yarn $y_1$ in accordance with the rotative speed of the bobbin 7. In this case, since the elastic yarn $y_2$ passes between the pressure surfaces of the rotary and press disks 8 and 9, it is subjected to a braking force corresponding to the pressing force, said braking force due to the pressing force being kept constant by the spring 28 or by the weight of the press disk 9, so that the elastic yarn $y_2$ is stretched at a constant rate under a tension opposing the pulling force of the stretch feeder 3 while it is wrapped around the nonelastic Yarn $y_1$.

Thus, the degree of stretch of the elastic yarn $y_2$ is at a constant value determined by the relation between the pulling force depending upon the pulling speed of the stretch feeder 3 and the pressing force of the pressure surfaces of the rotary and press disks 8 and 9, while the number of wraps of the elastic yarn $y_2$ around the nonelastic yarn $y_1$ is determined by the rotative speed of the rotary bobbin 7 and the pulling rate of the stretch feeder 3. As an example, 70- or 140-denier wooly nylon yarn is used as the nonelastic yarn $y_1$ and 20- or 40-denier spandex yarn is used as the elastic yarn $y_2$, while the RPM of the bobbin 7 is 10,000 and the pulling rate of the stretch feeder 3 is 50 m/min. In this case, the elastic yarn $y_2$ is wrapped around the nonelastic yarn $y_1$ about 200 times per m of the nonelastic yarn while the elastic yarn is being stretched three times its nonstretched length.

The yarn leaving the wrapping device 5, until it reaches the stretch feeder 3, is in the form of the nonelastic yarn $y_1$ having the elastic yarn $y_2$ wrapped therearound, but after leaving the stretch feeder 3, because the take-up rate of the take-up section 4 is lower than the delivery rate of the stretch feeder 3, the elastic yarn $y_2$, which has been stretched, is contracted to change positions with the nonelastic yarn $y_1$ so that the elastic yarn $y_2$ becomes the core yarn, having the nonelastic yarn $y_1$ wrapped therearound, and in this condition the covered yarn Y is taken up by the take-up section 4.

Figure 3B:
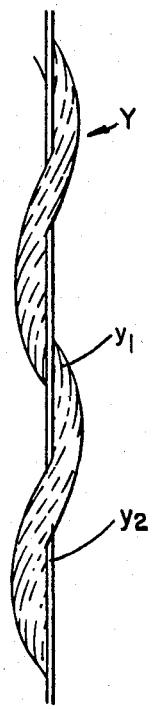
FIG. 3B is a view similar to FIG. 3A, but showing the elastic covered yarn of the present invention in stretched state.
Figure 3A:
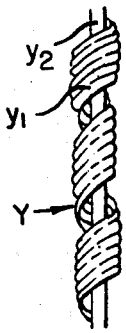
FIG. 3A is a side view of a portion of the elastic covered yarn of the present invention showing the yarn in contracted state.
Figure 2:
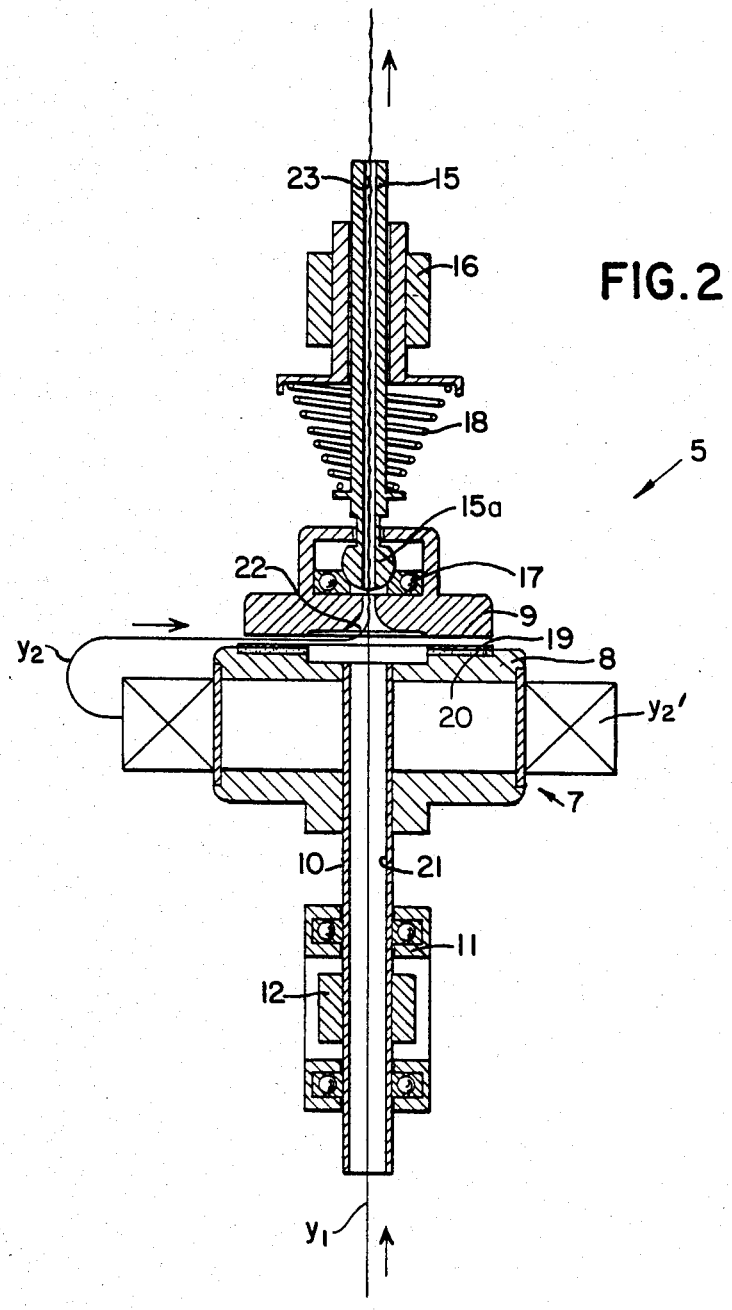
FIG. 2 is a longitudinal section of a wrapping device in the apparatus of FIG. 1.

The elastic covered yarn Y produced in this manner is such that with the elastic yarn $y_2$ contracted naturally, the nonelastic yarn $y_1$ wraps itself around the elastic yarn $y_2$ to softly cover the latter, as shown in FIG. 3(A), but when the yarn Y is stretched, the core yarn, or the elastic yarn $y_2$, is stretched in that condition, as shown in FIG. 3(B). At any rate, this elastic covered yarn Y is produced not by wrapping the nonelastic yarn $y_1$ around the elastic yarn $y_2$ but by wrapping the elastic yarn $y_2$ around the nonelastic yarn $y_1$, so that the nonelastic yarn $y_1$ has no twist whatsoever imparted thereto; thus while retaining the initial hand, it is softly wrapped around and covered with the elastic yarn $y_2$ and the hand is satisfactory.

Figure 4:
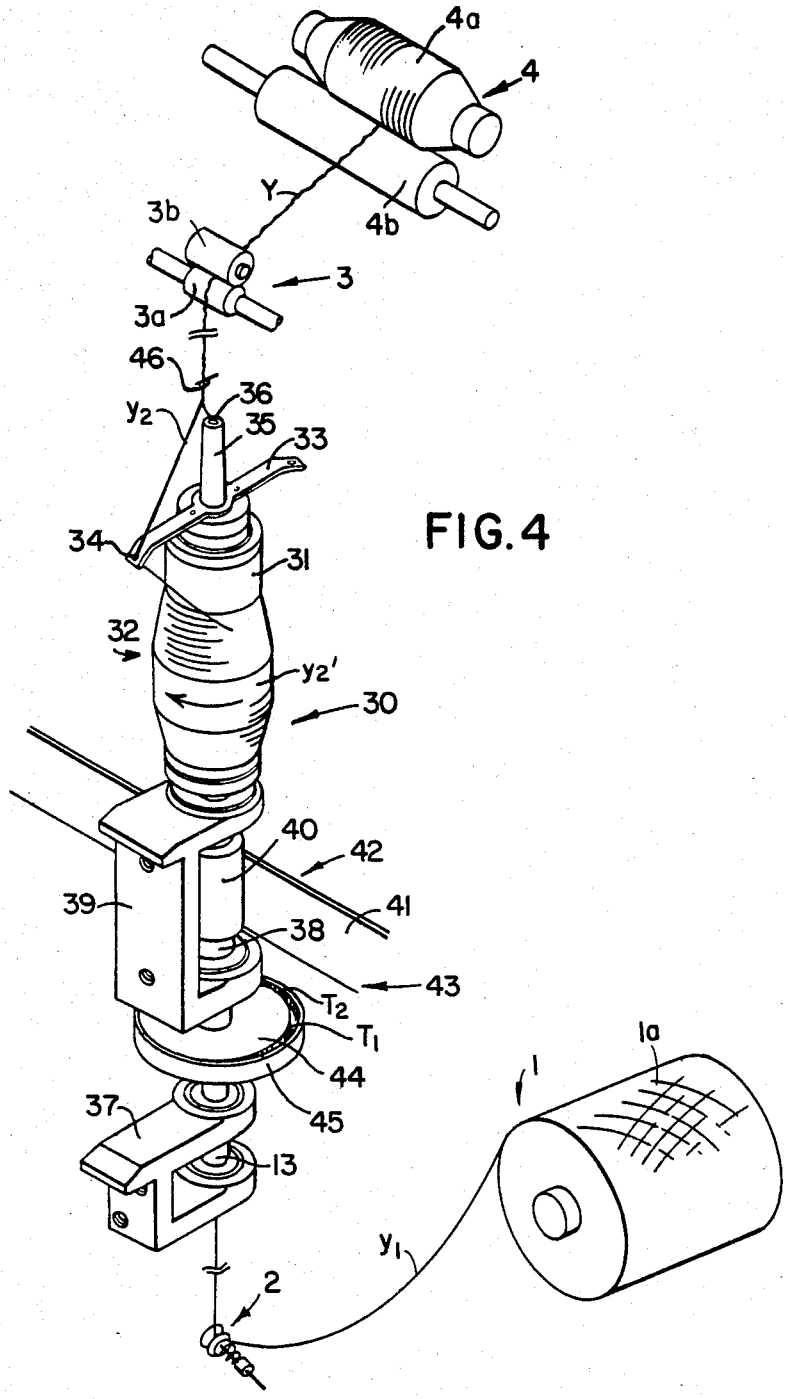
FIG. 4 is a perspective view of another example of an apparatus embodying the method of the invention.

FIG. 4 shows an example of another apparatus particularly preferable to embody the method of the invention. This apparatus has modified the wrapping device of the apparatus of the FIG. 1, as follows.

The wrapping device 30 of the apparatus of FIG. 4 comprises an elastic yarn bobbin 32 having the elastic yarn $y_2$ wound as a winding $y_2'$ on a winding core 31, and a flyer 33 for guiding the elastic yarn $y_2$ being wrapped around the nonelastic yarn $y_1$ while it is positively unwinding the elastic yarn at a constant speed by its rotary motion relative to said bobbin 32. In this case, the elastic yarn bobbin 32 is such that the amount of winding of the elastic yarn $y_2$ per course around the winding core 31, i.e., the actual wound length of the elastic yarn $y_2$ per course calculated for its nonstretched condition is substantially constant throughout from beginning to end irrespective of changes in the winding diameter which are produced as the elastic yarn is wound on the winding core.

The flyer 33 is of suitable arm shape having a yarn guide hole 34 at its front end through which the elastic yarn $y_2$ is passed, said flyer being mounted on the top of the elastic yarn bobbin 32. The flyer 33 is fixedly secured to the upper end portion of a slender spindle 35 of suitable length vertically extending along the path of travel of the nonelastic yarn $y_1$. The flyer-attaching spindle 35 is a cylindrical hollow spindle having a guide passage 36 in the center extending throughout the length along the path of travel of the nonelastic yarn $y_1$ and is rotatably supported by a bearing member 37 fixed to the frame (not shown) of the apparatus.

The elastic yarn bobbin 32 has its winding core 31 fitted on the upper portion of a cylindrical hollow spindle 38 rotatably fitted on said flyer-attaching spindle 35 over a suitable length below said flyer 35. The bobbin-mounting spindle 38 is rotatably supported at its lower end by another bearing member 39 fixed to the frame of the apparatus.

Thus, the flyer-attaching spindle 35 and the bobbin-mounting spindle 38 form a double cylindrical spindle, with the former inside and the latter outside and with the two spindles being independently rotatable relative to each other.

The bobbin-mounting spindle 38 is rotated at a constant speed by suitable constant speed rotary drive means 42 comprising a driven rotary body 40 such as a roller or pulley attached adjacent the bearing member 39 or at other suitable place, and a rotary drive belt 41 for said driven rotary body. Thus, the elastic yarn bobbin 32 mounted thereon is rotated at a constant speed in one direction.

The bobbin-mounting spindle 38 and the flyer-attaching spindle 35 are operatively interconnected by a differential rotary interlocking mechanism 43 installed at a suitable place between the bearing members 39 and 37, whereby the spindles are rotated relative to each other in the same direction at constant speeds with a constant differential rotative speed ratio such that the RPM of spindle 39 is greater than that of the spindle 37. The differential rotary interlocking mechanism 43 comprises an external gear wheel 44 having teeth $T_1$ on its outer periphery and fixedly attached to the bobbin-mounting spindle 38, and an annular internal gear wheel 45 having teeth $T_2$ on its inner periphery surrounding said external gear wheel 44 and fixedly attached to the flyer-attaching spindle 35, said gear wheels 44 and 45 having their teeth $T_1$ and $T_2$ engaged with each other at a predetermined peripheral place. The number of teeth $T_1$ of the external gear wheel 44 is somewhat smaller than the number of teeth $T_2$ of the internal gear wheel 45. As for the gear ratio, for example, the number of teeth of the external gear wheel 44 is 120 and that of the internal gear wheel is 121.

Thus, in this wrapping device 30, the elastic yarn bobbin 32 and the flyer 33 are substantially coaxially supported, and as the elastic yarn bobbin 32 is rotated at a constant speed in one direction by the rotation of the spindle 38 effected by the rotary drive means 42, the flyer 33 is rotated relative to and at the same direction as the bobbin 32 but at lower RPM than that of the bobbin 2. The nonelastic yarn $y_1$ is inserted into the guide passage 36 formed centrally through the flyer-attaching spindle 35, so that the nonelastic yarn $y_1$ smoothly travels upwardly through the device 30 in a direction substantially along the axes of the elastic yarn bobbin 32 and flyer 33, from the tension guide 2 toward the stretch feeder 3. In this apparatus, if the RPM of the flyer 33 is made smaller than that of the elastic yarn bobbin 32, the directions of rotation of the elastic yarn bobbin 32 and flyer 33 are the same as the wrapping direction of the elastic yarn $y_2$ on the elastic yarn bobbin 32.

In the apparatus of FIG. 4, the nonelastic yarn $y_1$ is pulled from the supply section 1 by the stretch feeder 3 to travel at a constant speed under a constant tension, and at a position where the traveling nonelastic yarn $y_1$ upwardly leaves the guide passage 36 of the wrapping device 30, the elastic yarn $y_2$ from the rotating elastic yarn bobbin $y_2$ is guided through the yarn guide hole 34 of the flyer 33 rotating in the same direction to be supplied to the nonelastic yarn $y_1$. In this way, the elastic yarn $y_2$ is wrapped around the nonelastic yarn $y_1$ traveling at a constant speed, with the number of wraps (twists) equal to the RPM of the flyer 33, by the rotary motion of the flyer 33. In addition, at the wrapping place, preferably a yarn guide 46 is provided for wrapping operation. The flyer 33 and the elastic yarn bobbin 32 are rotating at constant speeds in the same direction corresponding to the direction of winding of the elastic yarn $y_2$ on the bobbin 32, and since the RPM of the flyer 33 is set at a value lower than that of the elastic yarn bobbin 32 by the differential rotary interlocking mechanism 43, the elastic yarn $y_2$ is positively unwound or delivered at a constant speed from the elastic yarn bobbin 32 by an amount corresponding to the difference in RPM, i.e., the difference by which the RPM of the elastic yarn bobbin 32 exceeds that of the flyer 33. Further, since the elastic yarn bobbin 32 is in the form of the elastic yarn $y_2$ wound on the winding core 31 such that the amount of winding per course, i.e., the actual wound length per course is substantially constant irrespective of changes in the winding diameter due to the shape of the winding $y_2'$, the amount of the elastic yarn $y_2$ delivered per course around the elastic yarn bobbin 32, i.e., the actual length delivered per course, is substantially unchanged or constant. Therefore, on the basis of the constant traveling speed of the nonelastic yarn $y_1$ being pulled by the stretch feeder 3 and the suitable ratio of the constant speeds of the elastic yarn bobbin 32 and flyer 33, the elastic yarn $y_2$ is stretched at all times and with the degree of stretch maintained stabilized and accurately at a constant value, it is wrapped around the nonelastic yarn $y_1$ with a constant number of wraps per unit length.

As an example, suppose that the elastic yarn bobbin 32 has the elastic yarn $y_2$ wound on the winding core 31 at a rate of 10 cm per course irrespective of changes in the winding diameter, that the ratio of the RPMs of the flyer 33 and bobbin 32 is 120:121, and that the number of revolution of the flyer 33 during which the nonelastic yarn $y_1$ is caused to travel 1 m by the stretch feeder 3 is 400 and the corresponding number of revolutions of the bobbin 32 is about 403.333. Then, it follows that the elastic yarn $y_2$ is delivered about 0.333 m from the bobbin 32 per m of the nonelastic yarn $y_1$, so that it is wrapped 400 times while being stretched 3 times its nonstretched length. Further, if the RPM of the flyer 33 is 10,000, the rate at which the stretch feeder 3 pulls the yarn, or the traveling speed of the nonelastic yarn $y_1$ is 25 m/min. core 31 at a rate of 10 cm per course irrespective of changes in the winding diameter, that the ratio of the RPMs of the flyer 33 and bobbin 32 is 120:121, and that the number of revolution of the flyer 33 during which the nonelastic yarn $y_1$ is caused to travel 1 m by the stretch feeder 3 is 400 and the corresponding number of revolutions of the bobbin 32 is about 403.333. Then, it follows that the elastic yarn $y_2$ is delivered about 0.333 m from the bobbin 32 per m of the nonelastic yarn $y_1$, so that it is wrapped 400 times while being stretched 3 times its nonstretched length. Further, if the RPM of the flyer 33 is 10,000, the rate at which the stretch feeder 3 pulls the yarn, or the traveling speed of the nonelastic $y_1$ is 25 m/min.

The yarn formed by wrapping the elastic yarn $y_2$ around the nonelastic yarn $y_1$ in this manner is such that, as in the case of the apparatus of FIG. 1, until the yarn reaches the stretch feeder 3, the nonelastic yarn $y_1$ forms the core yarn, having the elastic yarn $y_2$ wrapped therearound in stretched condition, but after the yarn leaves the stretch feeder 3, since the take-up speed of the take-up section 4 is lower than the delivery speed of the stretch feeder, the elastic yarn $y_2$, which has been stretched, is relaxed and thereby contacted, so that the elastic and nonelastic yarns $y_2$ and $y_1$ change positions, with the elastic yarn $y_2$ forming the core yarn, having the nonelastic yarn $y_1$ wrapped therearound, thus forming the elastic covered yarn Y, which is taken up by the take-up section 4.

Thus, according to the method using the apparatus of FIG. 4, the elastic yarn $y_2$ is wrapped around the nonelastic yarn $y_1$ with the degree of stretch and the number of wraps per unit length being accurately maintained constant. Thus, the resulting elastic covered yarn Y is of uniform quality without unevenness in the wrapping pitch of the nonelastic yarn $y_1$ around the elastic yarn $y_2$. In this respect, it is possible to produce an elastic covered yarn which is superior in quality to the one obtained by the apparatus of FIG. 1.

In addition, in the apparatus of FIG. 4, the differential rotary interlocking mechanism 43 is not limited to the arrangement wherein the RPM of the flyer 33 is lower than that of the bobbin 32; contrarily, it may be so arranged that the RPM of the flyer 33 is higher than that of the bobbin 32, in which case, the directions of rotation of the flyer 33 and bobbin 32 should be opposite to the winding direction of the elastic yarn y on the bobbin 32. As for the rotary drive mechanism 42, the flyer attaching spindle 35 may, of course, be driven for rotation instead of the elastic yarn bobbin-mounting spindle 38. Further, the differential rotary interlocking mechanism 45 is not limited to the one comprising the external and internal gear wheels 44 and 45. For example, it may be a gear mechanism of different construction or other suitable differential interlocking mechanism. Alternatively, two systems of constant speed rotary drive means having a predetermined different gear ratio may be used to drive the two spindles 38 and 35 individually, or other various suitable arrangements may be used.

In the wrapping device 30 of the apparatus of FIG. 4, since the flyer 33 is positioned above the bobbin 32, in order to rotate the flyer 33 at a rotative speed different from that of the bobbin 32, the spindle 35 for rotation of the flyer 33 must be extended through the bobbin 32 so that rotation can be transmitted thereto from below. To this end, the spindle is in the form of a cylindrical double spindle wherein the cylindrical flyer-attaching spindle 35 extends through the cylindrical bobbin-mounting spindle 38. Thus, the construction is rather complicated.

Figure 5:
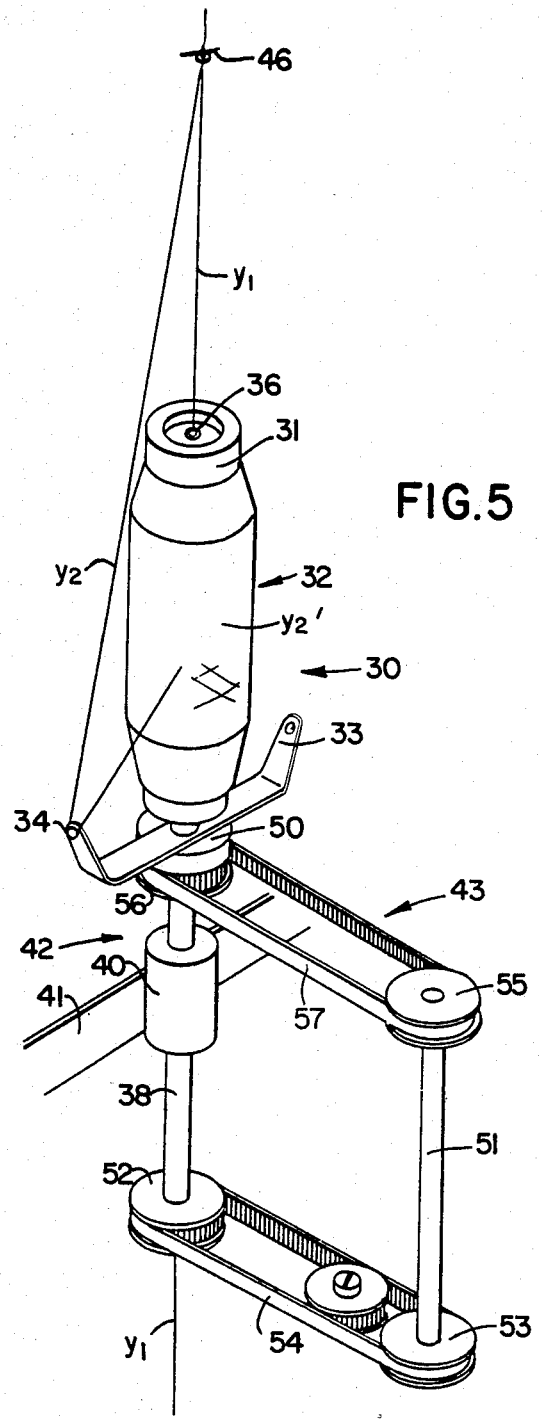
FIG. 5 is a perspective view of a modification of the wrapping device in the apparatus of FIG. 4.

To simplify the construction, the wrapping device 30 can be modified as shown in FIG. 5, wherein the flyer 33 is positioned below the bobbin 32. That is, in the modification shown in FIG. 5, the elastic yarn bobbin 32 is mounted on the upper portion of a cylindrical hollow spindle 38 centrally formed with a guide passage 36 for the nonelastic yarn $y_1$, said spindle 38 being driven at its lower end by suitable rotary drive means 42 comprising a driven rotary body 40 and a belt 42, while the flyer 33 is attached to a rotary wheel 50 rotatably mountd on the spindle 38 below the bobbin 32, and a rotary transmission shaft 51 is installed laterally of the spindle 38, said spindle 38 and transmission shaft 51 being operatively connected by pulleys 52 and 53 and a belt 54, said transmission shaft 51 and rotary wheel 50 being operatively connected by pulleys 55 and 56 and a belt 57, thereby forming a differential rotary interlocking mechanism 43. In this manner, the rotation of the spindle 38 caused by the rotary drive means 42 is transmitted to the rotary wheel 50 through the transmission shaft 51 at a constant RPM ratio so as to rotate the flyer 33 relative to the bobbin 32 at a different rotative speed. Thus, according to the modification shown in FIG. 5, it is not necessary to construct the spindle in the form of a double cylindrical spindle, as in the case of FIG. 4, providing the advantage of being simple in construction.

Figure 6:
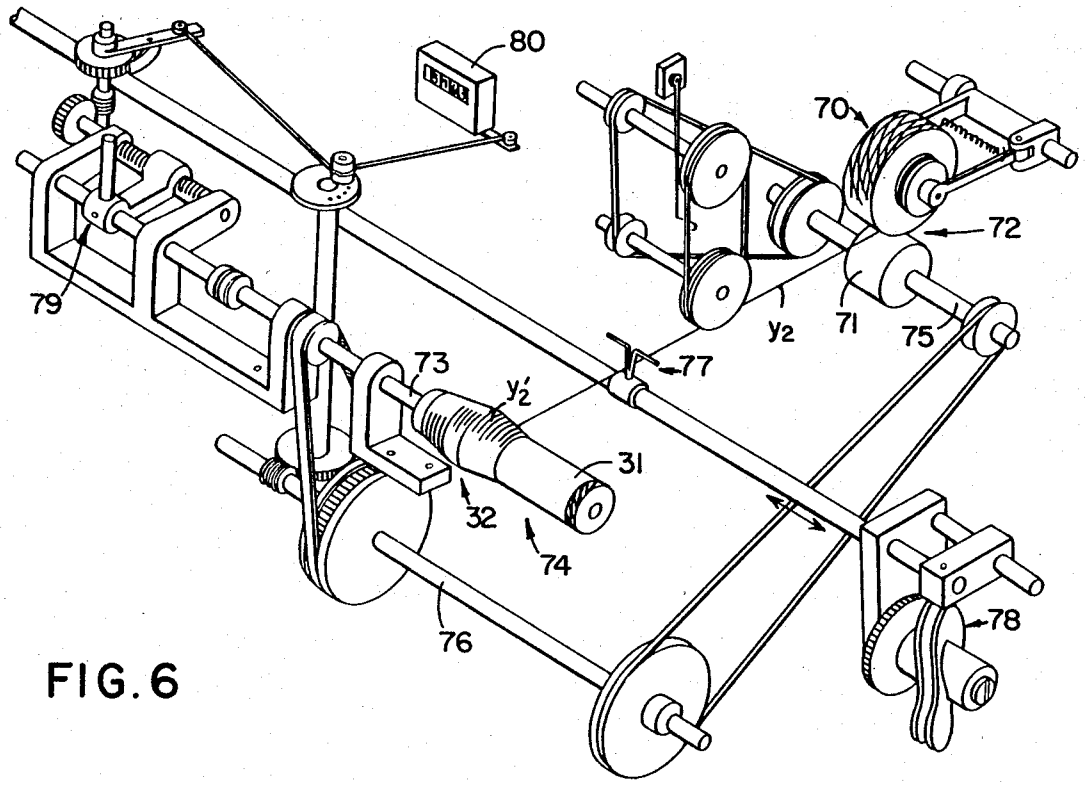
FIG. 6 is a perspective view of an example of a winding device for forming elastic yarn bobbins supplied to the apparatus of FIG. 4 or 5.

As for the elastic yarn bobbin 32 used in embodying the elastic covered yarn producing method using the apparatus shown in FIG. 4 or 5, the elastic yarn $y_2$ can be wound on the winding core 31 by using a winding device exemplified in FIG. 6.

The winding device shown in FIG. 6 comprises a feeder 72 wherein an elastic yarn wound body 70 in general form such as a cheese formed by winding the elastic yarn $y_2$ at a constant speed is pressed against the outer periphery of a rotary press drum 71 and is thereby rotated so as to positively deliver the elastic yarn $y_2$ from the wound body 70, and a take-up section 74 wherein a winding core 31 is mounted on a spindle 73 and thereby rotated to wind the elastic yarn $y_2$ being delivered from said feeder into a winding $y_2'$ of desired shape, thus providing an elastic yarn bobbin of desired shape. In this winding device, the rotary shaft 75 of the press drum 71 and the spindle 73 for mounting the winding core 31 of the take-up section 74 and rotating the same are rotated by being operatively connected to a common main shaft 76. Thus, the constant speed rotation of the main shaft 76 maintains the rotative speed of the press drum 71 and the rotative speed of the winding core 31 in a constant speed relation.

As a result, in this winding device, the feeder 72, corresponding to the rotative speed of the press drum 71, positively delivers a substantially constant amount of elastic yarn $y_2$ from the wound body 70 at a constant speed equal to the peripheral speed of the outer periphery of the drum to feed it to the take-up section 74, while the elastic yarn $y_2$ being thus delivered at the substantially constant feed rate is wound on the winding core 31 at a speed corresponding to the constant rotary speed of the winding core 31 due to the constant speed rotation of the spindle 73.

Thus, according to this winding device, if the rotative speed of the press drum 71 and the rotative speed of the spindle 71 are determined with respect to the interlocking relation to the main shaft 76 so that they have a constant speed relation such that the peripheral speed of the press drum is equal to or slightly less than the peripheral speed of the substantial outer periphery of the winding core 31 mounted on the spindle 73 (the outer periphery of the winding core surface exclusive of the elastic yarn being wound thereon), then even if the winding diameter increases gradually or in a repetitive wave fashion as the elastic yarn $y_2$ is wound on the winding core 31, the elastic yarn $y_2$ is wound at a substantially constant rate of winding per course on the winding core 31 throughout irrespective of said changes in the winding diameter. That is, as the elastic yarn $y_2$ is wound on the winding core 31 into the predetermined winding $y_2'$, the winding diameter changes to increase gradually or in a repetitive wave fashion, with the result that the peripheral winding speed changes to increase gradually or in a repetitive wave fashion, but since the elastic yarn $y_2$ is fed to the winding core 31 by a substantially constant amount at a constant speed which is at least lower than the peripheral winding speed, the gradual or repetitive wave-fashion changes in the peripheral winding speed toward increase relative to the feed speed are automatically adjusted in that the elastic yarn $y_2$ is correspondingly stretched and is wound on the winding core 31 with the degree of stretch increasing gradually or in a repetitive wave fashion. Therefore, the elastic yarn $y_2$ is wound on the winding core 31 in such a manner that the amount of winding per course, i.e., the substantial wound length calculated for the nonstretched condition is maintained substantially constant.

Thus, according to this winding device, it is possible to obtain the desired elastic yarn bobbin 32 applied to the apparatus shown in FIG. 4 or 5, having the elastic yarn $y_2$ wound with the amount of winding per course being maintained substantially constant irrespective of changes in the winding diameter.

In addition, the winding device is so arranged that the elastic yarn $y_2$ is wound on the winding core 31 while being given a traverse motion by a traverse guide 77 installed at a predetermined position, said traverse guide 77 being reciprocated with a fixed stroke in the direction of the length (axial direction) of the winding core 31 by an actuation mechanism 78 such as an actuation cam. The shift of the transverse range is effected by a winding core shifting device 79 operatively connected to a main shaft 79 adapted to axially inch the spindle 73 of the winding core 31. The total amount of winding of the elastic yarn $y_2$ on the winding core 31 is determined by a spindle RPM counter 80 operatively connected to the main shaft 76, whereby elastic yarn bobbins 32 accurate in the total amount of winding can be obtained.

What is claimed is:

1. A method of producing an elastic covered yarn capable of stretching and contracting from its stretched condition, said method comprising the steps of:

(a) feeding a non-elastic yarn at a constant speed in one direction as a core yarn over a straight portion of the length thereof while applying a predetermined tension force thereto;

(b) at the same time, continuously wrapping an elastic yarn around said straight portion of said non-elastic yarn as said non-elastic yarn is fed thereover under a predetermined tension, and while applying a stretching force to the elastic yarn at said straight portion as it is being wrapped; and (c) releasing the tensioning force from the non-elastic yarn and the stretching force from the elastic yarn after they have been moved past said straight portion;

(d) whereby to permit the covered yarn to contract after passing the straight portion so that the elastic yarn which when stretched was the cover yarn upon contraction becomes the core yarn and the non-elastic yarn which when tensioned was the core yarn upon release of tensioning becomes the cover yarn, softly and substantially covering the released elastic yarn, with no twist and with the non-elastic yarn being prevented from any substantially additional stretching.

2. An elastic covered yarn comprising a non-elastic yarn and an elastic yarn, said elastic covered yarn being capable of stretching and of contracting from its stretched position, the elastic yarn being stretched and being wrapped around a straight portion of said non-elastic yarn as said straight portion of said non-elastic yarn is fed at a constant speed in one direction as a core yarn under a pre-determined tension and said positions of said non-elastic and said elastic yarn being thereafter reversed upon releasing the tensioning force from the non-elastic yarn and stretching force from the elastic yarn after they have been moved past the straight portion so that upon such release, the covered yarn contracts after passage beyond the straight portion whereupon the elastic yarn which was stretched and when stretched was the cover yarn upon contraction becomes the core yarn and the non-elastic yarn which upon release of the tension becomes the cover yarn, and softly and substantially covers the released elastic yarn, with no twist and with the non-elastic yarn being prevented from any substantially additional stretching.

3. An elastic covered yarn made by the method of claim 1.

4. An apparatus for producing an elastic covered composite yarn consisting of a non-elastic yarn and an elastic yarn, said apparatus comprising:

(a) a non-elastic yarn supply section, (b) a composite yarn take-up section, (c) a stretch feeder for continuously pulling and feeding a non-elastic yarn in a straight run from said non-elastic yarn supply section to said take-up section, (d) an elastic yarn supply section, (i) said elastic yarn supply section comprising an elastic yarn bobbin having an elastic yarn wound thereon in such a manner that the amount of winding per course around said bobbin is substantially constant irrespective of changes in the winding diameter, (e) means for continuously wrapping the elastic yarn unwound from said elastic yarn supply section in a stretched condition around said run of tensioned non-elastic yarn at a position between said non-elastic yarn supply section and said stretch feeder, (i) said means for wrapping comprising a flyer supported substantially coaxially with said bobbin and (ii) a guide passage for running and guiding said non-elastic yarn in a direction extending substantially along the axis of said bobbin and said flyer, (iii) said flyer being capable of executing relative rotative motion at a constant speed relative to said bobbin so as to serve to guide a positive unwinding of said elastic yarn from said bobbin at a constant speed, (f) said composite yarn relaxing after passing the take-up section whereupon the elastic yarn which was stretched and when stretched was the cover yarn, upon relaxation contracts to become the core yarn and the non-elastic yarn about which the stretched elastic yarn was wrapped and which elastic yarn then was the core yarn upon relaxation becomes the cover yarn, and softly and substantially covers the released elastic yarn, being prevented from any substantially additional twisting.

* * * * *